US006397650B1

(12) United States Patent
Sakurai et al.

(10) Patent No.: US 6,397,650 B1
(45) Date of Patent: Jun. 4, 2002

(54) ROLL STAND FOR BAR AND WIRE ROD ROLLING MILL

(75) Inventors: Tomoyasu Sakurai; Takao Ogawa; Ryo Takeda; Yoshihiro Shinkai, all of Kurashiki; Shigeharu Ochi; Takeshi Tange, both of Niihama, all of (JP)

(73) Assignees: Kawasaki Steel Corporation, Kobe; Sumitomo Heavy Industries, Ltd., Tokyo, both of (JP)

( * ) Notice: Subject to any disclaimer, the term of this patent is extended or adjusted under 35 U.S.C. 154(b) by 0 days.

(21) Appl. No.: 09/719,814

(22) PCT Filed: May 12, 2000

(86) PCT No.: PCT/JP00/03070

§ 371 (c)(1),
(2), (4) Date: Dec. 18, 2000

(87) PCT Pub. No.: WO01/00345

PCT Pub. Date: Jan. 4, 2001

(30) Foreign Application Priority Data

Jun. 24, 1999 (JP) ..... 11-178476

(51) Int. Cl.[7] ..... B21B 13/10
(52) U.S. Cl. ..... 72/224; 72/249
(58) Field of Search ..... 72/224, 249, 235

(56) References Cited

U.S. PATENT DOCUMENTS

| | | | | | |
|---|---|---|---|---|---|
| 2,071,712 A | * | 2/1937 | Stuting | ..... | 72/224 |
| 5,144,827 A | * | 9/1992 | Iio | ..... | 72/224 |
| 5,953,948 A | * | 9/1999 | Isozaki | ..... | 72/224 |

FOREIGN PATENT DOCUMENTS

| | | | | | |
|---|---|---|---|---|---|
| JP | 61-150703 | * | 7/1985 | ..... | 72/235 |
| JP | B2 2667043 | | 6/1997 | | |

* cited by examiner

*Primary Examiner*—Lowell A. Larson
(74) *Attorney, Agent, or Firm*—Oliff& Berridge, PLC

(57) ABSTRACT

The present invention relates to a roll stand for bar and wire rod rolling mill, capable of being applied to various sizes of bars and wire rods by a small number of housing block sets, permitting maintenance work therefor to be carried out easily, and having characteristics in the housing thereof. The roll stand for bar and wire rod rolling mill according to the present invention is characterized in that the housing is divided into two, i.e. a roll block and a driving block by a plane including a position in which a driving gear and a driven gear are meshed with each other or a position in the vicinity of this position, whereby the number of housing block sets to be prepared is reduced. This enables the housing manufacturing cost to be lowered, and the replacement of a roll to be carried out efficiently.

6 Claims, 5 Drawing Sheets

ROLL STAND FOR BAR AND WIRE ROD ROLLING MILL

TECHNICAL FIELD

This invention relates to a roll stand for bar and wire rod rolling mill, capable of being adapted to the rolling of bars and wire rods by a small number of housing block sets and carrying out maintenance work therefor easily, and having characteristics in a housing thereof.

BACKGROUND OF THE INVENTION

There is a roll stand disclosed in Japanese Patent No. 2667043, as a related art example of a roll stand for bar and wire rod rolling mill. In this roll stand, a plane in which a rotary shaft of each groove roll exists and a plane in which a rotary shaft of a driving gear for each groove roll exists are parallel to each other along a pass line. The rotary shaft of each groove roll is mounted fixedly with a driven gear meshed with a relative driving gear. Namely, each groove roll is rotated by the rotation of a relative driving gear via a relative driven gear. Each groove roll has an eccentric shaft supporting the groove roll rotatably, and a clearance between the rolls can be regulated. A housing of this roll stand is of a three-piece structure.

The construction of this roll stand is shown in FIGS. 1–3. The roll stand shown in these drawings is of a four-roll type.

FIG. 1 is a perspective view showing an external appearance and a divided condition of the roll stand. A reference numeral 70 denotes an external appearance, and 80 denotes a divided condition of the roll stand, in which the roll stand is separated into three blocks 81, 82, 83. A reference numeral 1 denotes a groove roll, 3 denotes a driven gear, 2 denotes a driving gear, and 8 denotes a pass line. Referring to FIG. 1, a left side surface of the block 81 along the pass line and a right side surface of the block 82 along the pass line correspond to planes in which a rotary shaft of each groove rolls exist. Referring to FIG. 1, a left side surface of the block 82 along the pass line and a right side surface of the block 83 along the pass line correspond to planes in which the rotary shafts of the driving gears for the groove rolls exist.

FIG. 2 is a side view along the pass line showing the relation among a housing block, roll stand housing dividing positions, the groove rolls, driving gears and driven gears. Referring to FIG. 2, a pitch circle of the driving gear 2 of FIG. 1 is shown by a one-dot chain line 20, and that of the driven gear 3 of FIG. 1 fixed on the rotary shaft of each groove roll 1 is shown by a one-dot chain line 30. A point 61 denotes a center of rotation of the groove roll and driven gear, a point 62 denotes a center of rotation of the driving gear, and a point 63 denotes a center of rotation of the eccentric shaft 6. Referring to FIG. 2, the roll stand 80 is divided into the three blocks 81, 82, 83 from the side of a plane 72 by the plane 71 in which the axes of rotation of the four groove rolls 1 exist and by the plane 72 in which the axis of rotation of the driving gear 2 for each groove roll 1 exists. As shown in FIG. 2, the plane 72 is in a position which is parallel-spaced from the plane 71 along the pass line 8.

FIG. 3 is an enlarged view of an upper portion of FIG. 2. The eccentric shaft 6 and rotary shaft 7 are hatched. As shown in FIG. 3, the rotary shaft 7 of the groove roll is made hollow. In the hollow of the rotary shaft 7, the eccentric shaft 6 is supported rotatably with respect to the rotary shaft 7. A distance between the driving gear 2 and driven gear 3 can be changed in accordance with a rotation of the eccentric shaft 6. The reason resides in the following. The driving gear 2 is retained so as to be rotated in a predetermined position at all times. When the eccentric shaft 6 is rotated for the regulation (called "parting regulation") of an inter-roll clearance, a center 61 of rotation (i.e. a center of rotation of the rotary shaft 7) of the driven gear 3 moves along an arc having as its center a center 63 of rotation of the eccentric shaft 6. When upper and lower rolls come closest to each other, the center 61 of rotation reaches a position 612. When they come apart most, it reaches a position 611. A parting regulation amount $\alpha$ corresponds to a distance between points 611 and 612.

Especially, FIG. 3 shows a condition in which the eccentric shaft 6 is in a top dead center (position closest to the driving gear) of the eccentric arc. This condition is also a condition in which the driven gear 3 has a central value of the partition regulation, and a distance between centers of the driving gear 2 and driven gear 3 is so maintained that the gears 2, 3 are correctly meshed with each other (standard pitch circles thereof contact each other). When an eccentric position of the eccentric shaft 6 deviates from the upper dead center, the distance between the centers of the driving gear 2 and driven gear 3 slightly increases. Due to the increase of the center distance, a backlash between the gears increases but this does not cause a problem in particular concerning the meshing of the gears. Accordingly, the parting regulation amount $\alpha$ can be changed.

A roll rotating mechanism including the driven gear 3 and the groove roll 1 are housed in the interior of the first block 81 which constitutes a cover for the groove roll, and the second block 82 which is a part between the plane 71 and plane 72. A driving mechanism including the driven gear 2 is housed in the interior of the second block 82 and the third block 83 which constitutes a cover for the driving mechanism. The replacement of the groove roll 1 is carried out with removing the first block, and the maintenance work for the driving mechanism with removing the third block 83.

In the roll stand having a housing of such a three-piece structure, it is necessary that the first block 81 and second blocks 82 be used in a 1:1 unit for the convenience of the engagement of an outer circumference of a seal for a neck portion of the groove roll 1 and a circumference of the rotary shaft of the roll, and that these blocks be kept in a set. Namely, the first blocks 81 and second block 82 out of different block sets cannot be combined and used together. Therefore, when only one set of first block 81 and second block 82 is available, a rolling operation cannot be carried out during the replacement of the groove roll 1. In order to carry out a rolling operation efficiently without stopping the same, it is necessary to have a large number of block sets of housing. Especially, these days, many types of small lots of products have been demanded, and a required number of block sets tends to increase more and more.

In order to prevent refuse and dust from entering the interior of the housing, it is necessary that the roll stand be kept with the three blocks in an assembled state. Therefore, a lot of space is required, and the handling of the roll stand becomes troublesome.

As described above, there is yet room for improvement in the related art roll stand with respect to the cost of manufacturing of the housing and the way of handling the same.

DISCLOSURE OF THE INVENTION

To solve the problems of reducing the cost and facilitating the handling of the housing of the related art roll stand for bar and wire rod rolling mill, the roll stand for bar and wire rod rolling mill according to the present invention has been made which is characterized in that a housing thereof is divided into two, i.e. a roll block and a driving block by a plane including a position in which a driving gear and a driven gear are meshed with each other or a position in the vicinity thereof. Namely, the present invention is a roll stand formed of a roll block including a groove roll, a driven gear fixed on a rotary shaft of the groove roll, an eccentric shaft supporting the groove roll rotatably thereon, and a housing in which these parts are incorporated; and a driving block including a driving gear, and a housing in which the driving gear is incorporated, a plane in which the roll block and driving block contact each other being parallel to a plane which includes the rotary shaft of the groove roll and a plane which includes a rotary shaft of the driving gear, and constituting a plane which includes meshed portions or their vicinity portions of the driving gear and driven gear which cross a pass line at right angles thereto. The driving gear and driven gear mentioned above are preferably spur gears or helical gears.

BEST MODE FOR CARRYING OUT THE INVENTION

A mode of embodiment of the present invention will now be described.

Figure 1:
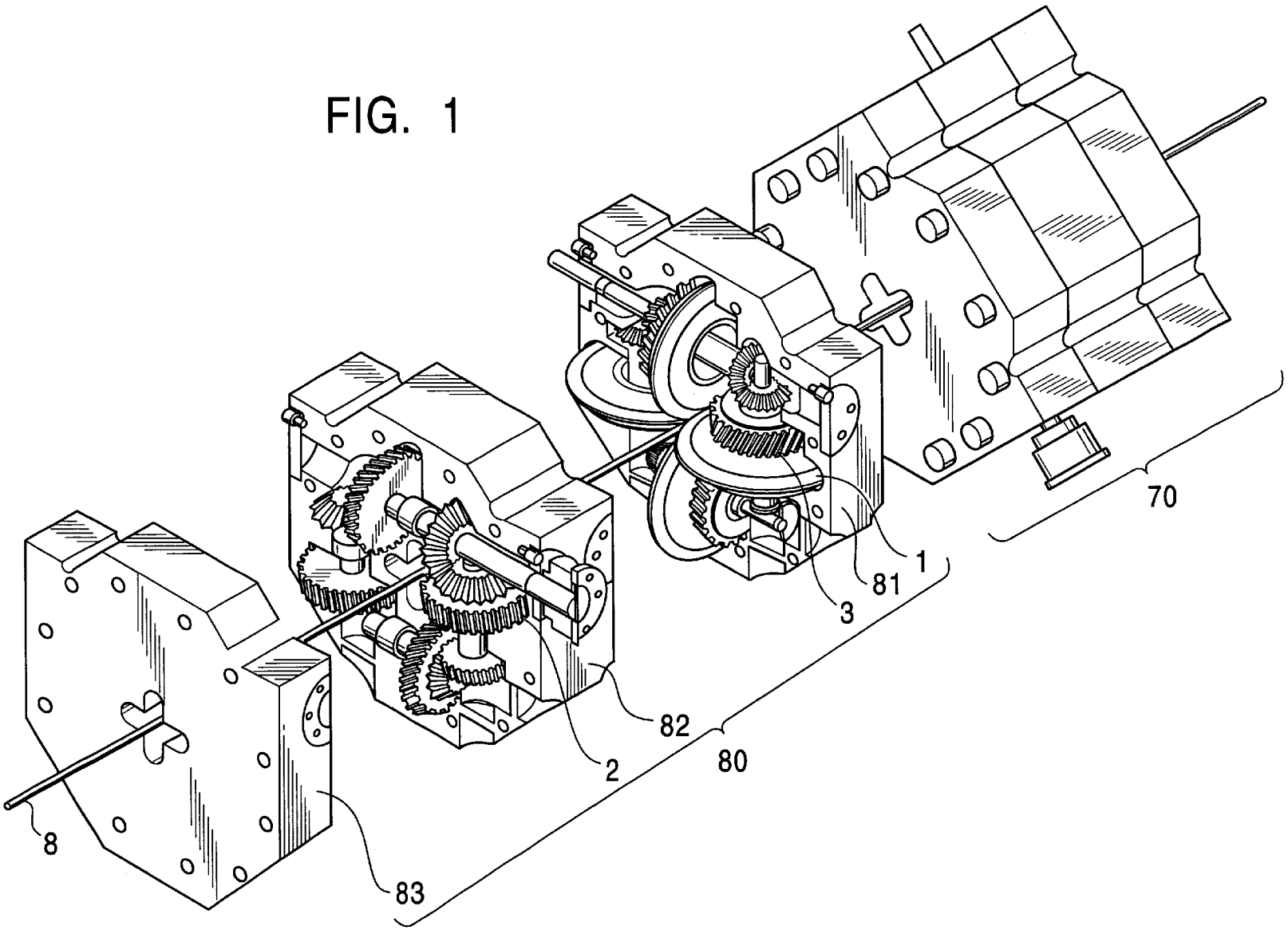
FIG. 1 is a perspective view showing an external appearance and a divided condition of a related art roll stand for rolling machines.
Figure 2:
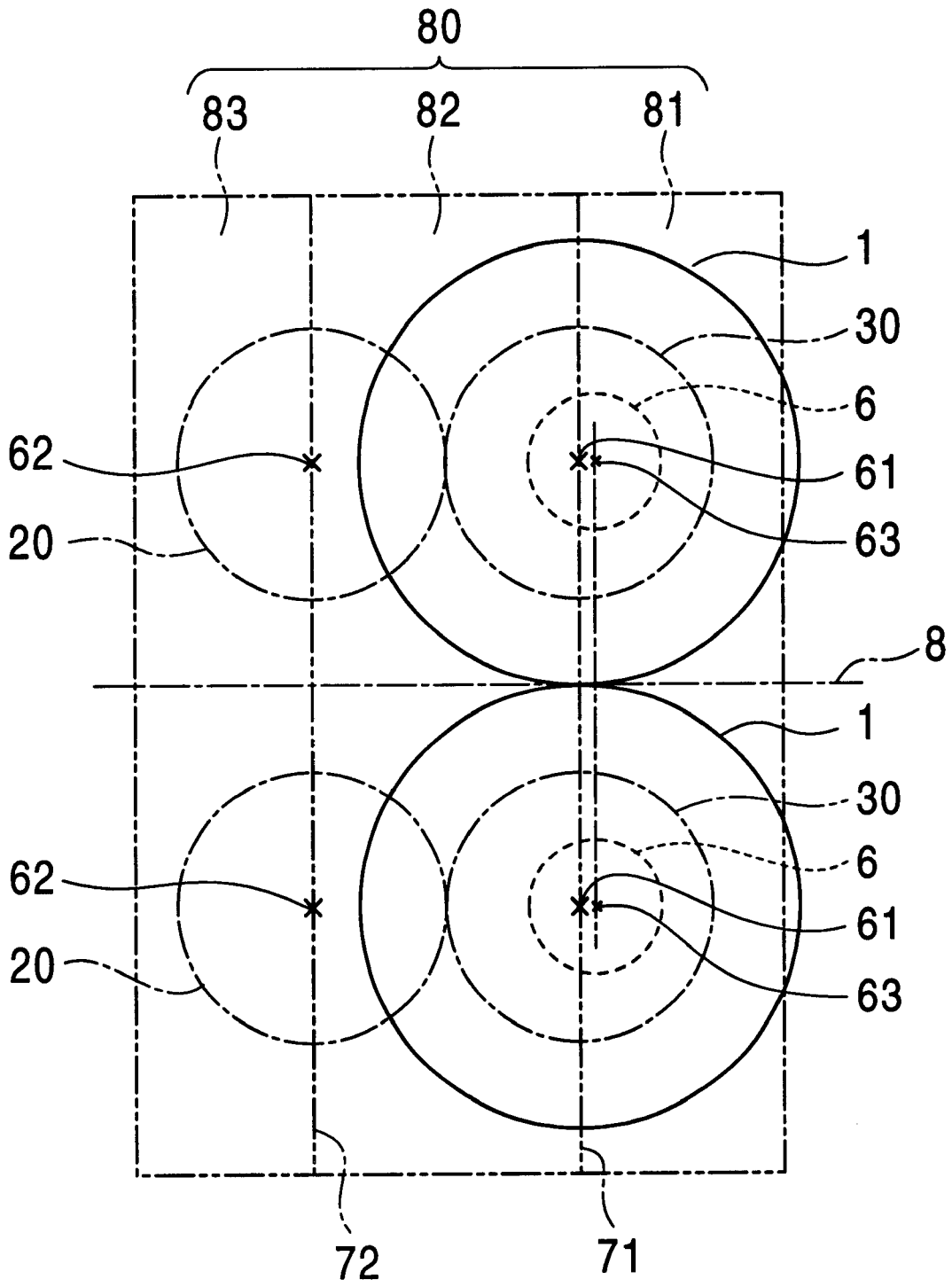
FIG. 2 is a side view along a pass line showing the relation among housing blocks, housing dividing positions, groove roll, driving gear and driven gear of the related art roll stand for rolling machines.
Figure 3:
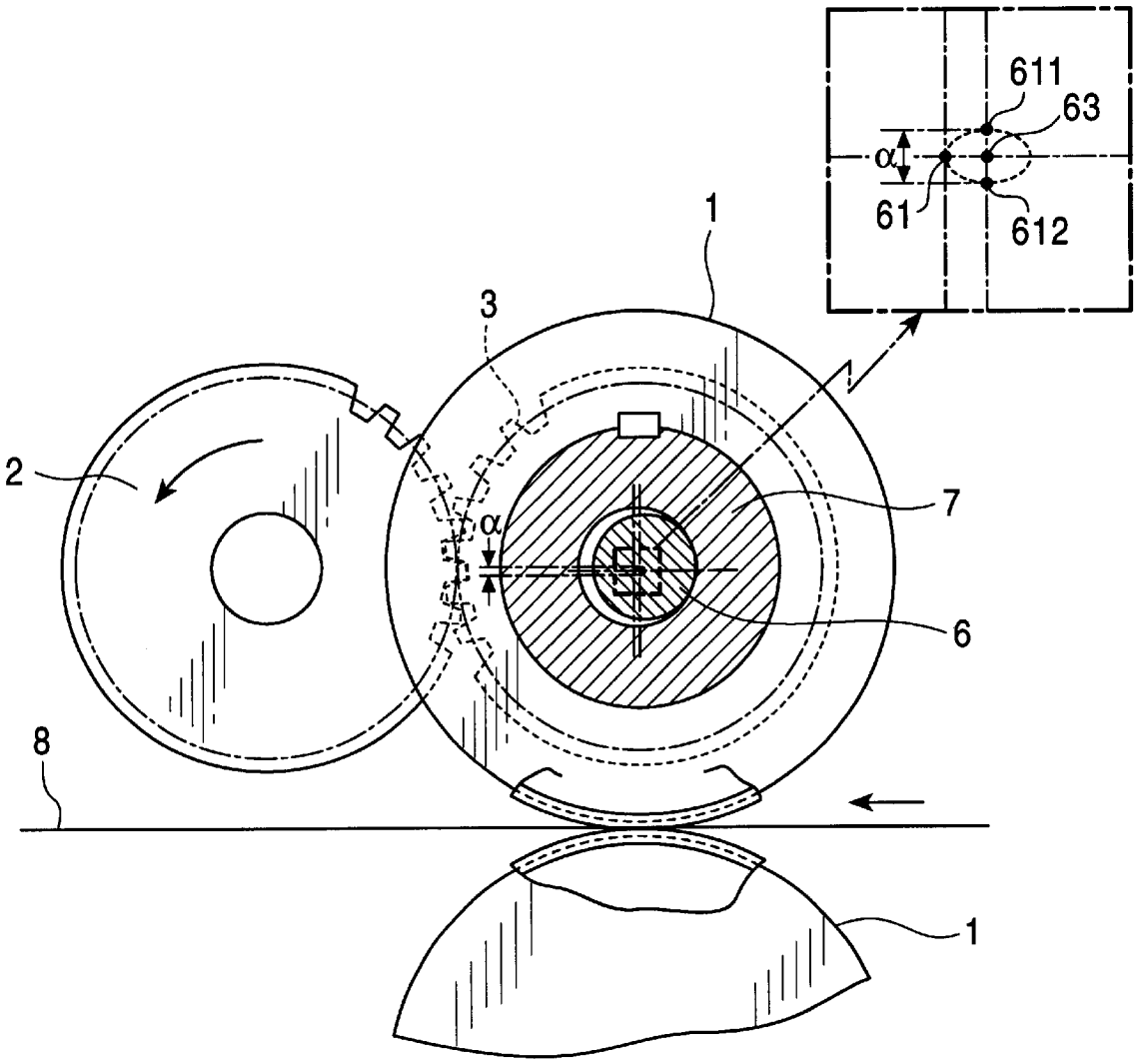
FIG. 3 is a side view showing the meshing relation between the driving gear and driven gear during a parting regulation operation.
Figure 4:
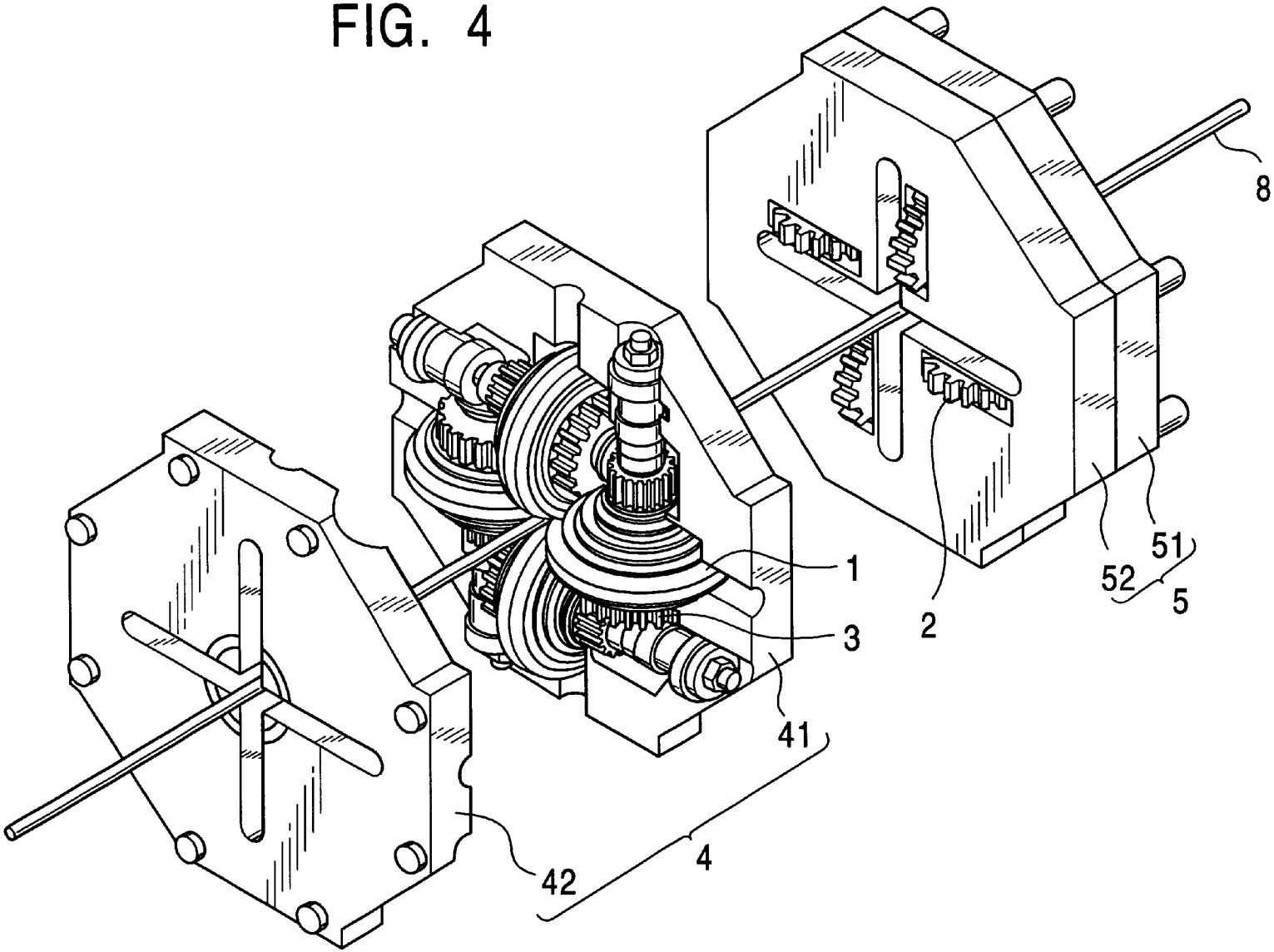
FIG. 4 is a perspective view showing a partially divided condition of a housing in a mode of embodiment of the roll stand for rolling machines according to the present invention.
Figure 5:
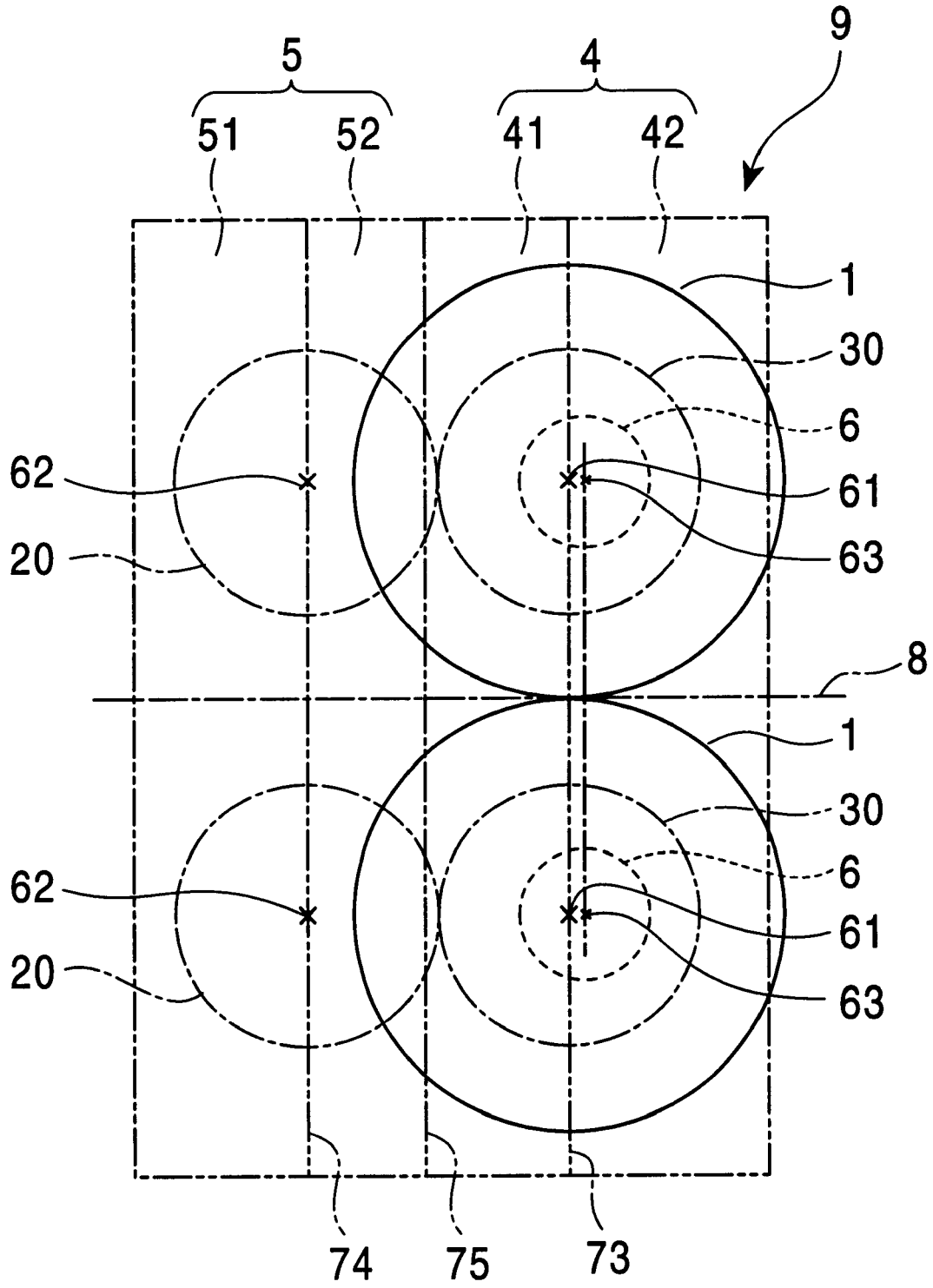
FIG. 5 is a side view along a pass line showing the relation among housing blocks, housing dividing positions, groove roll, driving gear and driven gear in the mode of embodiment of the roll stand for rolling machines according to the present invention.

A mode of embodiment of the roll stand for rolling machines according to the present invention is shown in FIGS. 4 and 5. FIG. 4 is a perspective view showing a partially divided condition of a housing. The housing is divided into four blocks 41, 42, 51, 52. A set of 41, 42 constitutes a roll block 4, and a set of 51, 52 constitutes a driving block 5. Joint surfaces of the blocks 41, 42 correspond to a plane in which a rotary shaft of each groove roll exists. Joint surfaces of the blocks 51, 52 correspond to a plane in which a rotary shaft of a driving gear for each groove roll exists. A reference numeral 1 denotes the groove roll, 3 denotes a driven gear, 2 denotes a driving gear, and 8 denotes a pass line.

FIG. 5 is a side view along the pass line showing the relation among housing blocks, housing dividing positions, groove roll, driving gear and driven gear. Referring to FIG. 5, a pitch circle of the driving gear of FIG. 4 is shown by a one-dot chain line 20, and that of the driven gear 3 of FIG. 4, which is fixed on the rotary shaft of each groove roll 1, is shown by a one-dot chain line 30. A point 61 denotes center of rotation of the groove roll and driven gear, a point 62 denotes a center of rotation of the driving gear, and a point 63 denotes a center of rotation of an eccentric shaft 6.

This roll stand is an example of a four-roll type roll stand. Referring to FIG. 5, rotary shafts of four groove rolls 1 exist in a plane 73 perpendicular to the pass line 8, and a rotary shaft of the driving gear 2 for each groove roll 1 exist in a plane 74 parallel-spaced from the plane 73 along the pass line 8. A driven gear 3 meshed with each driving gear 2 is fixed on the rotary shaft of each groove roll 1, and each groove roll 1 is rotated via each driven gear 3 in accordance with a rotation of each driving gear 2. The driving gear 2 and driven gear 3 are spur gears, and the remaining portions are formed by a combination of known techniques.

The housing 9 of this roll stand is divided into the roll block 4 and driving block 5 by a plane 75 existing between and parallel to the plane 73 and the plane 74. The plane 75 exists in a position which is in the vicinity of a contact point of the pitch circle 20 of the driving gear 2 and that 30 of the driven gear 3, and which is slightly separated from the contact point toward the driving gear 2 (a position in the vicinity of a position in which the driving gear and driven gear are meshed with each other). Accordingly, the roll block 4 and driving block 5 are combined with each other with a high position accuracy by the driving gear 2 and driven gear 3 formed of spur gears. Therefore, the positioning of the roll block 4 and driving block 5 during the assembling of the roll stand can be done by a method of not so high an accuracy, such as a knock pin method.

The roll block 4 of the housing 9 is divided into two portions 41, 42 by the plane 73 in which the rotary shafts of four groove rolls 1 exist. The driving block 5 of the housing 9 is divided into two portions 51, 52 by the plane 74 in which the rotary shafts of four driving gears 2 exist. It is necessary that the combining of the two divisional members 41, 42 of the roll block 4 together and the two divisional members 51, 52 of the driving block 5 together be done by a method in which a highly accurate positioning operation is carried out in the same manner as in a method applied to a related art three-piece roll stand, i.e., by a so-called joint processing method in which the divisional members are combined together and processed. However, it is not necessary that the roll block and driving block be produced by the joint processing method.

Since the housing has such a construction, the roll block 4 and driving block 5 in the mode of embodiment of the roll stand according to the present invention can be kept separately. When inner portions of the roll block 4 and driving block 5 are formed to the same structure with the same spur gears used for both the driving gear 2 and driven gear 3, any one of plural roll blocks and any one of plural driving blocks can be combined together arbitrarily, and these blocks may not be correspondingly prepared in a 1:1 unit.

For example, the number of sets of driving blocks 5 which the roll stand should possess can be selected from any of (1) two sets including a set mounted on a rolling machine and a set being disassembled or assembled, (2) three sets including a set on standby in addition to the sets mentioned in (1), and (3) four sets excluding the sets being disassembled or assembled which are mentioned in (2). For example, the number of sets of roll blocks 4 which the roll stand should possess can be selected from any of (1) two sets including a set mounted on a rolling machine and a set being disassembled or assembled, (2) three sets including a set on standby (a set combined with a driving side portion 5) in addition to the sets mentioned in (1), and (3) n sets including sets, which have different groove rolls therein, in addition to the sets mentioned in (2). It is unnecessary to set the roll block 4 and the driving block 5 to an equal number, and any combination of the numbers of blocks can be employed.

Assume that, for example, in order to attain a certain level of actual results of rolling operation using a related art roll stand having a housing of a three-piece structure, it is necessary to possess three sets of roll stands (unitary housing sets) including a set mounted on a rolling machine, a set being disassembled or assembled and a set on standby. In order to attain the same level of actual results of rolling operation using the roll stand of the mode of embodiment of the present invention, three sets of roll blocks and two sets of driving blocks 5 may be prepared, which may be combined arbitrarily and used as three units of roll stands. Thus, in the roll stand of the mode of embodiment of the present invention, the number of prepared roll stands in terms of the number of housings in a unitarized state can be reduced lower than that in the case of the related art roll stand, and the cost of manufacturing the housing can also be lowered.

The replacement of the groove roll 1 in the mode of embodiment of the present invention can be carried out quickly in the following order.

1. Remove the roll stand from a rolling machine.
2. Carry the roll stand into a roll shop.
3. Divide the roll stand housing into a roll block 4 and a driving block 5.
4. Assemble the roll stand by combining the driving block 5 with another roll block 4.
5. Carry the roll stand out of the roll shop and mount the same on the rolling machine.

In the roll stand of the related stand, combining a driving block with a roll block prepared in advance as mentioned in 4. is impossible, so that it is necessary to carry out an operation for renewing the block as a whole or incorporating a renewal roll into the removed roll block. In the former case, a required number of blocks increases, and, in the latter case, the handling of the roll stand becomes troublesome, and the rolling mill interruption time increases.

It is also necessary that a "roll alignment" operation for forming a cross section of a reference pass line by finely moving the groove roll be carried out after the groove roll is incorporated into the housing. In the roll stand according to the present invention, the roll alignment operation of the roll block 4 alone can be done before the roll block 4 and driving block 5 of the housing are combined with each other. For example, a method can be employed which has the steps of throwing light from a lower side of the roll block 4 thereinto, projecting an enlarged image onto a projector disposed on an upper side of the roll block, and carrying out roll alignment operation while observing the enlarged image.

On the other hand, in the related art housing of a three-piece structure, carrying out a roll alignment operation in a mere groove roll-incorporated condition is impossible. Since a roll alignment operation can be carried out only in a three-piece portion-combined condition, a large-scaled roll alignment operation device is necessarily used.

According to the roll stand of the mode of embodiment of the present invention, the dimensions of the roll alignment operation device can be reduced to a low level as compared with those of the roll alignment operation device used for the related art roll stand of a three-piece structure.

The housing in the present invention has a structure rarely permitting the entry of refuse and dust thereinto, though the housing is separated into the roll block 4 and driving block 5. Accordingly, this housing can be kept with the housing separated into the roll block 4 and driving block 5. Namely, according to the rolling stand of the mode of embodiment of the present invention, handling the housing in a unitarily combined state just as in the case of the related art roll stand which has a housing of a three-piece structure is not required, so that the efficiency in handling the housing is improved.

Although the driving gear 2 and driven gear 3 in the mode of embodiment so far described of the present invention are formed of spur gears, they may also be formed of helical gears or some other type of gears. However, in order to easily regulate the gears in the roll thrusting direction, the driving gear 2 and driven gear 3 are preferably formed of spur gears or helical gears.

The roll stand of the mode of embodiment of the present invention so far described is a four-roll type roll stand having four groove rolls arranged around the pass line at 90° intervals in the circumferential direction but the present invention is not limited to this type. The present invention can also be applied to, for example, a three-roll type roll stand in which three groove rolls are arranged around the pass line at 120° intervals in the circumferential direction, and a roll stand similar thereto.

Industrial Applicability:

According to the present invention, the number of housing block sets to be prepared is reduced to thereby enable the cost of manufacturing the housing to be lowered, the replacement of the rolls to be carried out efficiently, and the efficiency in handling the housing to be improved.

What is claimed is:

1. A roll stand for bar and wire rod rolling mill, comprising a roll block including a groove roll, a driven gear fixed on a rotary shaft of the groove roll, an eccentric shaft supporting the groove roll rotatably thereon, and a housing having first and second roll block portions in which these parts are incorporated; and a driving block including a driving gear, and a housing having first and second driving block portions in which the driving gear is incorporated, a dividing plane in which the roll block and driving block contact each other being parallel to a first plane between the first and second roll block portions which includes the rotary shaft of the groove roll and a second plane between the first and second driving block portions which includes a rotary shaft of the driving gear, the dividing plane further constituting a plane which includes meshed portion of the driving gear and driven gear or their vicinity portions which cross a pass line at right angles thereto.

2. A roll stand for bar and wire rod rolling mill according to claim 1, wherein the driving gear and driven gear are spur gears or helical gears.

3. A roll stand for bar and wire rod rolling mill according to claim 2, wherein the roll stand includes four groove rolls, which are arranged around the pass line at 90° intervals in the circumferential direction.

4. A roll stand for bar and wire rod rolling mill according to claim 2, wherein the roll stand includes three groove rolls, which are arranged around the pass line at 120° intervals in the circumferential direction.

5. A roll stand for bar and wire rod rolling mill according to claim 1, wherein the roll stand includes four groove rolls, which are arranged around the pass line at 90° intervals in the circumferential direction.

6. A roll stand for bar and wire rod rolling mill according to claim 1, wherein the roll stand includes three groove rolls, which are arranged around the pass line at 120° intervals in the circumferential direction.

* * * * *